US006043168A

United States Patent [19]

Colman et al.

[11] Patent Number: 6,043,168

[45] Date of Patent: Mar. 28, 2000

[54] INTERNAL AND TOPICAL TREATMENT SYSTEM FOR NONWOVEN MATERIALS

[75] Inventors: Charles W. Colman, Marietta; Samuel E. Marmon; Xin Ning, both of Alpharetta; Debra J. McDowall, Roswell; Christopher C. Creagan, Marietta, all of Ga.

[73] Assignee: Kimberly-Clark Worldwide, Inc., Neenah, Wis.

[21] Appl. No.: 08/920,480

[22] Filed: Aug. 29, 1997

[51] Int. Cl.[7] ..... D01F 1/10

[52] U.S. Cl. ..... 442/118; 442/361; 442/401; 442/414; 264/211; 264/211.14

[58] Field of Search ..... 442/414, 401, 442/361, 118; 264/211, 211.14

[56] References Cited

U.S. PATENT DOCUMENTS

| | | |
|---|---|---|
| 3,580,735 | 5/1971 | Shimodio et al. . |
| 3,632,715 | 1/1972 | Gowdy et al. . |
| 3,847,676 | 11/1974 | Palmer et al. . |
| 3,918,995 | 11/1975 | Palmer et al. . |
| 4,378,431 | 3/1983 | Brown, Jr. . |
| 4,396,389 | 8/1983 | Löfgren . |
| 4,413,032 | 11/1983 | Hartmann et al. . |
| 4,851,284 | 7/1989 | Yamanoi et al. . |
| 4,861,539 | 8/1989 | Allen et al. . |
| 4,898,700 | 2/1990 | Yoshinari et al. . |
| 4,999,245 | 3/1991 | Orino et al. . |
| 5,033,172 | 7/1991 | Harrington . |
| 5,045,387 | 9/1991 | Schmalz . |
| 5,130,196 | 7/1992 | Nishio et al. . |
| 5,225,263 | 7/1993 | Baravian et al. . |
| 5,277,851 | 1/1994 | Ford et al. . |
| 5,300,357 | 4/1994 | Gardiner . |
| 5,429,629 | 7/1995 | Latimer et al. ..... 604/378 |
| 5,456,982 | 10/1995 | Hansen et al. . |
| 5,464,687 | 11/1995 | Sheth . |
| 5,582,904 | 12/1996 | Harrington . |
| 5,620,788 | 4/1997 | Garavaglia et al. . |

*Primary Examiner*—Terrel Morris
*Assistant Examiner*—Cheryl Juska
*Attorney, Agent, or Firm*—Pauley Peterson Kinne & Fejer

[57] ABSTRACT

A nonwoven web material of polymeric fibers having at least one internal surfactant and at least one topical surfactant. The internal surfactant is an organosilicon compound. The topical surfactant is at least one of an ethoxylated hydrogenated fatty oil, a monosaccharide, a monosaccharide derivative, a polysaccharide, and a polysaccharide derivative. The nonwoven web material treated with internal and external surfactants has improved durability and processability over conventional materials treated with only internal or topical surfactants.

39 Claims, No Drawings

INTERNAL AND TOPICAL TREATMENT SYSTEM FOR NONWOVEN MATERIALS

FIELD OF THE INVENTION

This invention relates to a system for treating nonwoven materials using topically applied and internally applied treatments to provide improved durability and processability, particularly compared to nonwoven materials to which internal or topical treatments alone have been applied. More particularly, this invention relates to a nonwoven web material comprising a plurality of polymeric fibers treated with at least one internal surfactant and at least one topical surfactant whereby the topical surfactant imparts durable wettability to the nonwoven web material and the internal surfactant imparts instantaneous wettability to the nonwoven web material and aids in the application of the topical surfactant.

BACKGROUND OF THE INVENTION

Absorbent personal care articles such as sanitary napkins, disposable diapers, incontinent-care pads and the like are widely used, and much effort has been made to improve the effectiveness and functionality of these articles. These articles generally include a liquid absorbent material backed by a liquid-impervious barrier sheet. To enhance the sense of comfort, the absorbent material has a facing of a material which masks at least the body-facing surface of the product. The purpose of this cover material is to help structurally contain the absorbent material and to protect the wearer from continuous direct contact with moisture from previously wetted absorbent material. The cover material is typically a relatively low basis weight nonwoven fabric. Improved product performance has been obtained in these products through the incorporation of a surge management material disposed between this cover material and the absorbent material. (See U.S. Pat. No. 5,429,629.) The surge management material is made from a relatively high basis weight, low density, that is thick, nonwoven web material. The cover material must, therefore, be permeable to liquids on the side of the product that is placed against the body, actively promoting the immediate transfer of each liquid application or insult through the surge management material and into the absorbent pad. It is also necessary that the surge management material initially hold the liquid passed through the cover material and then give up said liquid to the absorbent material.

In order to satisfy these requirements, it is necessary that the surfaces of the cover material and surge management material or the surface of the fibers forming said nonwoven fabrics, be first wetted by the liquid. Wettability of nonwoven webs or fibers thereof is known to be achievable by treating the surface thereof with surfactants. See, for example, U.S. Pat. No. 4,413,032 to Hartmann et al. and U.S. Pat. No. 5,045,387 to Schmalz. Alternative methods of imparting wettability to such materials are taught, for example, by U.S. Pat. No. 5,456,982 to Hansen et al. in which a bicomponent fiber is provided with permanent hydrophilic surface properties by incorporating a surface active agent into the sheath component and optionally by including a hydrophilic polymer or copolymer in the sheath component. See, also, U.S. Pat. No. 5,582,904 to Harrington which teaches the incorporation into a polyolefin-containing cast or spin-melt composition for production of nonwoven materials a modifier composition comprising at least one M,M-polyalkoxylated 10–22 carbon fatty acid amine, inclusive of amines having 12–20 carbon and preferably 18 carbon linear straight chain moiety corresponding to that found in stearic or oleic acid, and up to about 60%, including 0.1%–45% by weight of a modifier composition, of a primary or secondary 10–22 carbon fatty acid amide, such as stearamide.

We have found, however, that the use only of internal surfactants, which without a subsequent blooming step impart instantaneous wettability, results in fabrics that are not durable to multiple insults. By durability, we mean the ability of the material to withstand multiple insults. We have also found that a high basis weight, low density polyolefin web with an internal surfactant is desirable for improving treatability by a topical surfactant in order to provide good wettability. Fabrics without an internal surfactant, but which are topically treated with dilute solutions of surfactants, also exhibit good wettability. However, this approach is undesirable because a significant amount of drying is required.

Accordingly, it is one object of this invention to provide a nonwoven web material having improved durability and processability over conventional nonwoven materials treated with internal or topical surfactants alone.

It is another object of this invention to provide a dual treatment system, that is one employing both internal and topical surfactants, for improving the durability and processability of nonwoven web materials.

It is yet another object of this invention to provide a nonwoven web material which is instantaneously wettable so as to provide virtually instantaneous transport of liquids through the web.

SUMMARY OF THE INVENTION

These and other objects of this invention are achieved by a nonwoven web material comprising polymeric fibers treated by a dual treatment system of at least one internal surfactant and at least one topical surfactant. The at least one internal surfactant comprises an organosilicon compound and the at least one topical surfactant comprises a compound selected from the group consisting of an ethoxylated hydrogenated fatty oil, a monosaccharide, a monosaccharide derivative, a polysaccharide, a polysaccharide derivative, and combinations thereof. In accordance with one particularly preferred embodiment of this invention, the polymeric fibers are bicomponent fibers formed from polypropylene and polyethylene resins.

Such nonwoven web materials are produced by a method in accordance with this invention in which an internal surfactant comprising an organosilicon compound is added to a polyolefin resin, forming an organosilicon/polyolefin resin. The organosilicon/polyolefin resin is spun into a bicomponent spunbond web. At least one topical surfactant comprising a compound selected from the group consisting of an ethoxylated hydrogenated fatty oil, a monosaccharide, a monosaccharide derivative, a polysaccharide, a polysaccharide derivative, and combinations thereof, is applied to the intake side of the spunbond web.

The nonwoven web materials of this invention are suitable for use in limited use or disposable items, that is products and/or components used only a small number of times, or possibly only once, before being discarded. Examples of such products include, but are not limited to, surgical and health care related products such as surgical drapes and gowns, disposable work wear such as coveralls and lab coats, and personal care absorbent products such as diapers, training pants, incontinence garments, sanitary napkins, bandages, wipes and the like.

DEFINITIONS

As used herein, the term "internal surfactant" or "internal treatment" means a surfactant or treatment that is in the molten polymer during the extrusion process.

As used herein, the term "topical surfactant" or "topical treatment" means surfactants or treatments that are applied to formed fibers or fabrics made from such fibers.

As used herein, the term "nonwoven web" means a web that has a structure of individual fibers or threads which are interlaid, but not in an identifiable, repeating manner. Nonwoven webs have been, in the past, formed by a variety of processes such as, for example, melt-blowing processes, spunbonding processes, and bonded carded web processes.

As used herein, the term "spunbonded fibers" refers to small diameter fibers which are formed by extruding a molten thermoplastic material as filaments from a plurality of fine, usually circular, capillaries of a spinnerette with the diameter of the extruded filaments then being rapidly reduced as by, for example, eductive drawing or well-known spunbonding mechanisms.

As used herein, the term "polymer" generally includes, but is not limited to, homopolymers, copolymers, such as for example, block, graft, random and alternating copolymers, terpolymers, etc., and blends and modifications thereof. Furthermore, unless otherwise specifically limited, the term "polymer" includes all possible geometric configurations of the material, including, but not limited to, isotactic, syndiotactic, and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, waxes, solvents, and particulates.

As used herein, the term "bicomponent fibers" refers to various configurations including, but not limited to, side-by-side, core and sheath, pie segments, and islands in the sea configurations.

DESCRIPTION OF PREFERRED EMBODIMENTS

This invention relates to a dual treatment system for improving durability and processability of nonwoven web materials which combines topical and internal treatment of the polymeric fibers comprising the nonwoven web material. This system includes an internal surfactant which is added to the polyolefin resin utilized to make the nonwoven web, which polyolefin resin is then spun into the nonwoven web. The internal surfactant is one which does not require a heating step after its addition to the polyolefin resin in order to bloom. The internal surfactant provides instantaneous wettability to the nonwoven web and enhances the ability of the topical treatment to wet the web. Subsequent thereto, the topical treatment is applied to the intake side of the base nonwoven web. Whereas the internal surfactant by itself would have very limited durability, the topical treatment imparts substantially greater durability to the wettable finish of the nonwoven web.

Accordingly, a nonwoven web material in accordance with this invention comprises polymeric fibers comprising at least one internal surfactant and at least one topical surfactant. The at least one internal surfactant is a surfactant which blooms without additional heating after its addition to the polyolefin resin used to make the nonwoven web and preferably comprises an organosilicon compound. The at least one topical surfactant comprises at least one of an ethoxylated hydrogenated fatty oil, a monosaccharide, a monosaccharide derivative, a polysaccharide, and a polysaccharide derivative. In accordance with a particularly preferred embodiment, the polymeric fibers are bicomponent fibers formed from polypropylene and polyethylene resins.

In accordance with one preferred embodiment, the topical surfactant comprises an average of less than about 10% by weight of said fibers. In accordance with a particularly preferred embodiment, the topical surfactant comprises an average of about 0.1% to about 5.0% by weight of said fibers.

In accordance with one preferred embodiment, the internal surfactant comprises less than about 10% by weight of the polymeric fibers comprising the nonwoven web material. In accordance with a particularly preferred embodiment, the internal surfactant comprises in the range of about 0.1% to about 5% by weight of the polymeric fibers.

EXAMPLE

An internal surfactant, MASIL®SF-19, an alkoxylated polysiloxane available from PPG Industries, Inc., Specialty Chemicals Division, Gurnee, Ill., the chemical formula of which is as follows:

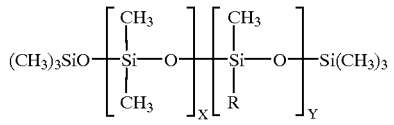

where R is defined as:

$$—CH_2CH_2CH_2O—(CH_2CH_2O)_P—(CH_2CH[CH_3]O)_Q—R^1$$

($R^1$=H or ALKYL)

and X, Y, P and Q are positive integers, which has the ability to lower the surface tension of water into the range of 20–21 dynes per centimeter from 72 dynes per centimeter at a usage level of about 0.1%, was added to polypropylene and polyethylene resins which were spun into a bicomponent spunbond web. This spunbond web was then spray treated with a 3% Ahcovel Base N-62/Glucopon 220 UP mixture in an active chemical ratio of 3:1. Ahcovel Base N-62 is a mixture of ethoxylated hydrogenated castor oil and sorbitan monooleate, the chemical formulas for which are as follows:

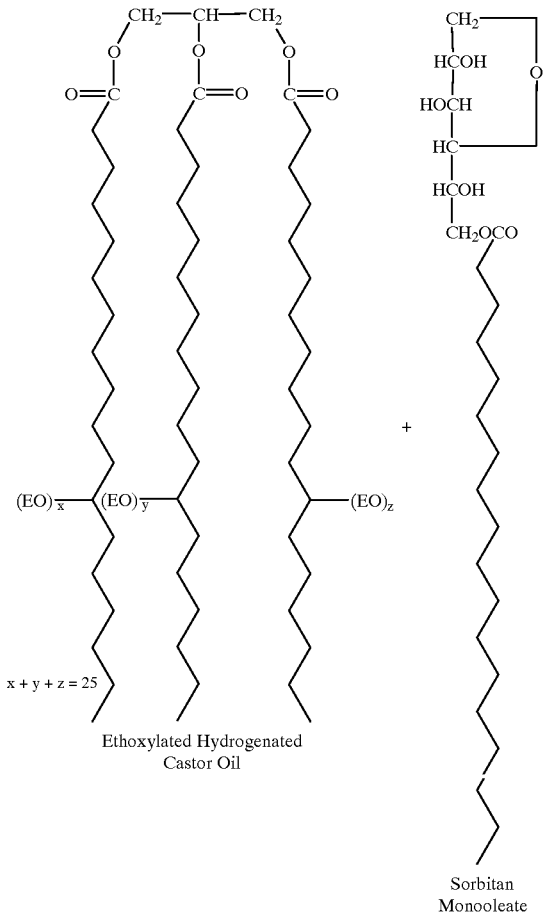

available from Hodgson Textile Chemicals, Mount Holly, N.C. and Glucopon 220 UP is an octylpolyglycoside, the chemical formula for which is as follows:

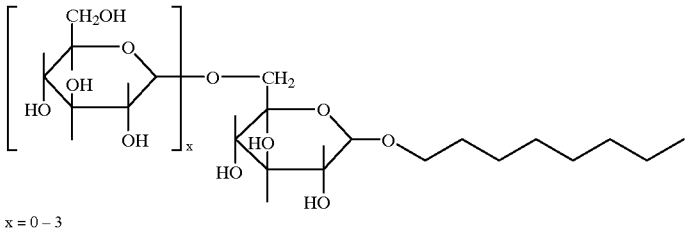

available from Henkel Corporation, Ambler, Pa. The resulting material was then evaluated for both wettability and durability, using the Multiple Insult Simulation Test (MIST) described hereinbelow. These results are shown in Table 1.

The Multiple Insult Simulation Test measures the amount of liquid (saline solution) that is held in a material when a specified volume of the liquid is applied to the material under specified conditions. It also measures the amount of liquid retained in the material after the liquid insulted material is placed in contact with an absorbent material, thereby allowing the liquid to transfer from the test material to the absorbent material. The test procedure involves calibration of a PUMP to deliver 80 grams of liquid in 4 seconds (average flow rate of 20 grams per second). A liquid collection pan is placed on a lab balance beneath the slit in the bottom of a cradle shaped, non-segmented specimen holder. The balance is then tared. The specimen to be evaluated, 2.5 inches wide and 7 inches long, is placed in the bottom of the cradle over a 2.5 inch wide portion of the slit that is taped to prevent liquid from passing through the part of the slit directly beneath the specimen. The slit in the bottom of the cradle runs across the center of the specimen in the direction of the width of the specimen. The ends of the specimen, in the longer dimension, are elevated above the center of specimen at approximately 60° from horizontal. The specimen is insulted by dispensing 80 grams of liquid at a rate of 20 grams per second directed vertically downward into the center of the specimen from the end of a fluid application wand held about 0.5 inches above the center of the specimen. The mass of the liquid in the collection pan is recorded and the balance tared. The specimen is then removed and placed on a tissue-covered absorbent material. The absorbent material is composed of a mixture of 60% Favor® 870 SAM available from Stockhausen GmbH and 40% wood pulp at a total weight of 500 g/m$^2$. A 397 gram 2.5 inch by 7 inch plate/weight is placed on top of the specimen to cover the full area of the specimen for 5 minutes. This procedure is then repeated 2 additional times. At least two specimens for each material are tested. The liquid held for each insult divided by the initial weight of the dry specimen and the liquid retained after each desorption divided by the initial weight of the dry sample are then calculated.

TABLE 1

| Treatment Chemistry | Application Method | Structure | Liquid Held/ Liquid Retained 1st Insult (g/g) | Liquid Held/ Liquid Retained 2nd Insult (g/g) | Liquid Held/ Liquid Retained 3rd Insult (g/g) |
|---|---|---|---|---|---|
| 3% A/G (3:1 ratio) | High Solids Spray | 3.1 dpf 0.025 g/cc | 13.6/0.09 | 14.8/0.09 | 15.3/0.11 |

TABLE 1-continued

| Treatment Chemistry | Application Method | Structure | Liquid Held/ Liquid Retained 1st Insult (g/g) | Liquid Held/ Liquid Retained 2nd Insult (g/g) | Liquid Held/ Liquid Retained 3rd Insult (g/g) |
|---|---|---|---|---|---|
| 0.7% SF-19 | Internal | 3.2 dpf 0.021 g/cc | 18.0/1.37 | 17.2/2.21 | 13.5/1.21 |
| 0.7% SF-19 3% A/G | Internal High Solids Spray | 3.2 dpf 0.021 g/cc | 16.9/0.12 | 17.2/0.45 | 17.7/0.82 |

Desired Values
>16 g/g liquid held for all three insults
<1 g/g liquid retained for all three insults Table 1 clearly shows that, while the internal surfactant, 0.70% SF-19, alone imparts instantaneous wettability, it is not durable to multiple insults. This is shown by the decrease in liquid held with multiple insults. In addition, the liquid retained in the specimen after it is desorbed is above the desired level of 1 g/g.

Table 1 also shows that the polyolefin web without the internal surfactant does not treat uniformly and, consequently, does not exhibit good wettability. For example, when treated with 3% Ahcovel/Glucopon (A/G) using a high solids spray treatment system, the liquid held by the web material is low, below the desired value of 16 g/g. However, the use of an internal surfactant in addition to the topical surfactant allows for wet out of the base nonwoven. For example, a nonwoven web with 0.7% SF-19 in the bicomponent fiber is treated using a high solids treater with 3% Ahcovel/Glucopon having a 3:1 ratio of A/G. As shown in the last row of Table 1, this material showed good initial wettability and improved durability as well as acceptable levels of liquid retention after desorption with this combination of treatments compared to treatments with internal surfactants or topical surfactants alone.

EXAMPLE

A side-by-side bicomponent spunbond was made having 1.25% SF-19 in the polypropylene side and 0.125% in the polyethylene side. The intake, or open side, of this fabric was in-line treated with Ahcovel/Glucopon using a high solids spray treater. The results are summarized in Table 2 hereinbelow.

TABLE 2

| Treatment Chemistry | Application Method | Liquid Held 1st Insult (g/g) | Liquid Held 2nd Insult (g/g) | Liquid Held 3rd Insult (g/g) |
|---|---|---|---|---|
| 3% A/G (3:1) Ratio | Dip/Extract | 16.6 | 17.9 | 18.1 |
| 0.7% SF-19 3% A/G | Internal High Solids Spray | 16.9 | 17.2 | 17.7 |
| 0.7% SF-19 | Internal | 18.0 | 17.2 | 13.5 |

The results summarized in Table 2 show that this material has similar wettability and durability to materials treated with Ahcovel/Glucopon using a low solids saturation technique (dip/extract) with hexanol as a wetting agent. However, the dual treatment system of this invention provides certain advantages over a conventional dip and squeeze process. In particular, the loft of the web is maintained in this new process compared to a 15% decrease in loft observed with dip and squeeze processes. In addition, the treatment system of this invention in which the topical surfactant is applied by a high solids spray treatment provides a lower wet pick-up compared to conventional dip and squeeze processes, thereby lowering drying requirements of the web during processing which, in turn, reduces production cost.

It will be apparent to those skilled in the art that the dual treatment system of this invention can be extended to other internal additives as well as other topical systems, with either other chemistries and/or other processes. The internal surfactant can be added to either the polypropylene or the polyethylene side in a side-by-side bicomponent or to the sheath in a sheath/core configuration. The use of an internal additive to aid in wetting out of the web in subsequent treatment application systems may also be done on a spunbond polypropylene web.

This invention is applicable to direct polymer-to-fabric nonwoven processes, such as single component spunbond and meltblown, in addition to bicomponent spunbond as discussed hereinabove.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A nonwoven web material comprising:

polymeric fibers comprising at least one internal surfactant and at least one topical surfactant, said at least one internal surfactant comprising an organosilicon compound and said at least one topical surfactant comprising a mixture including an ethoxylated hydrogenated fatty oil and a compound selected from the group consisting of a monosaccharide, a monosaccharide derivative, a polysaccharide and a polysaccharide derivative.

2. A nonwoven web material in accordance with claim 1, wherein said polymeric fibers are bicomponent fibers.

3. A nonwoven web material in accordance with claim 2, wherein said bicomponent fibers are formed from polypropylene and polyethylene resins.

4. A nonwoven web material in accordance with claim 1, wherein said topical surfactant is a mixture of octyl polyglycoside and an ethoxylated hydrogenated castor oil/sorbitan monooleate mixture.

5. A nonwoven web material in accordance with claim 1, wherein said internal surfactant comprises an average of less than about 10% by weight of said polymeric fibers.

6. A nonwoven web material in accordance with claim 1, wherein said topical surfactant comprises an average of less than about 10% by weight of said polymeric fibers.

7. A nonwoven web material in accordance with claim 5, wherein said internal surfactant comprises an average of about 0.3 to about 5.0% by weight of said polymeric fibers.

8. A nonwoven web material in accordance with claim 6, wherein said topical surfactant comprises an average of about 0.3 to about 5.0% by weight of said polymeric fibers.

9. A nonwoven web material in accordance with claim 2, wherein said bicomponent fibers form a spunbond web.

10. A method for producing a nonwoven web material comprising the steps of:

adding an internal surfactant comprising an organosilicon compound to a polyolefin resin, forming an organosilicon/polyolefin resin;

processing said organosilicon/polyolefin resin to form a nonwoven web material; and applying at least one topical surfactant to said nonwoven web material said at least one topical surfactant comprising a mixture including an ethoxylated hydrogenated fatty oil and a compound selected from the group consisting of a monosaccharide, a monosaccharide derivative, a polysaccharide and a polysaccharide derivative.

11. A method in accordance with claim 10, wherein said nonwoven web material is a bicomponent nonwoven web material.

12. A method in accordance with claim 11, wherein said bicomponent nonwoven web material comprises polypropylene and polyethylene.

13. A method in accordance with claim 10, wherein said topical surfactant is a mixture of octyl polyglycoside and an ethoxylated hydrogenated castor oil/sorbitan monooleate mixture.

14. A method in accordance with claim 10, wherein said internal surfactant is added to said polyolefin resin in an amount up to about 5% by weight of said polyolefin resin.

15. A method in accordance with claim 10, wherein said topical surfactant is applied to said nonwoven web material in an amount up to about 5% by weight of said nonwoven web material.

16. A dual treatment method for improving durability and processability of nonwoven materials comprising:

adding an internal additive comprising at least one organosilicon compound surfactant to a polyolefin resin prior to formation of said nonwoven material; and adding a topical surfactant comprising a mixture including an ethoxylated hydrogenated fatty oil and a compound selected from the group consisting of a monosaccharide, a monosaccharide derivative, a polysaccharide and a polysaccharide derivative, to a fluid intake side of said nonwoven materials.

17. A method in accordance with claim 16, wherein said topical surfactant is a mixture of octyl polyglycoside and an ethoxylated hydrogenated castor oil/sorbitan monooleate mixture.

18. A limited use or disposable article comprising:

a nonwoven material comprising polymeric fibers comprising at least one internal surfactant and at least one topical surfactant, said at least one internal surfactant comprising an organosilicon polymer and said at least one topical surfactant comprising a mixture including an ethoxylated hydrogenated fatty oil and a compound selected from the group consisting of a monosaccharide, a monosaccharide derivative, a polysaccharide and a polysaccharide derivative.

19. An article in accordance with claim 18, wherein said polymeric fibers are bicomponent fibers.

20. An article in accordance with claim 18, wherein said bicomponent fibers are formed from polypropylene and polyethylene resins.

21. An article in accordance with claim 18, wherein said topical surfactant is a mixture of octyl polyglycoside and an ethoxylated hydrogenated castor oil/sorbitan monooleate mixture.

22. An article in accordance with claim 18, wherein said article is a diaper.

23. An article in accordance with claim 18, wherein said article is a training pants.

24. An article in accordance with claim 18, wherein said article is an adult incontinent garment.

25. An article in accordance with claim 18, wherein said article is a medical garment.

26. A nonwoven web material comprising:

polymeric fibers formed from a mixture of a polyolefin resin and at least one internal surfactant and having at least one topical surfactant comprising a mixture including an ethoxylated hydrogenated fatty oil and a compound selected from the group consisting of a monosaccharide, a monosaccharide derivative, a polysaccharide and a polysaccharide derivative, said at least one internal surfactant having a capability to bloom without heating of said polymeric fibers and provide said polymeric fibers with instantaneous wettability.

27. A nonwoven web material in accordance with claim 26, wherein said at least one internal surfactant comprises an organosilicon compound.

28. A nonwoven web material in accordance with claim 26, wherein said topical surfactant is a mixture of octyl polyglycoside and an ethoxylated hydrogenated castor oil/sorbitan monooleate mixture.

29. A nonwoven web material in accordance with claim 26, wherein said internal surfactant comprises an average of less than about 10% by weight of said polymeric fibers.

30. A nonwoven web material in accordance with claim 26, wherein said topical surfactant comprises an average of less than about 10% by weight of said polymeric fibers.

31. A nonwoven web material in accordance with claim 29, wherein said internal surfactant comprises an average of about 0.1 to about 5.0% by weight of said polymeric fibers.

32. A nonwoven web material in accordance with claim 30, wherein said topical surfactant comprises an average of about 0.1 to about 5.0% by weight of said polymeric fibers.

33. A method for producing a nonwoven web material comprising the steps of:

adding an internal surfactant to a polyolefin resin, forming a surfactant/polyolefin resin mixture;

processing said surfactant/polyolefin resin mixture to form a nonwoven web material, said internal surfactant blooming within said nonwoven web material without application of additional heat to said nonwoven web material, thereby providing said nonwoven web material with substantially instantaneous wettability; and applying at least one topical surfactant to said nonwoven web material, said at least one topical surfactant comprising a mixture including an ethoxylated hydrogenated fatty oil and a compound selected from the group consisting of a monosaccharide, a monosaccharide derivative, a polysaccharide and a polysaccharide derivative.

34. A process in accordance with claim 33, wherein said at least one internal surfactant comprises an organosilicon compound.

35. A process in accordance with claim 34, wherein said topical surfactant is a mixture of octyl polyglycoside and an ethoxylated hydrogenated castor oil/sorbitan monooleate mixture.

36. A process in accordance with claim 33, wherein said nonwoven web material is a bicomponent nonwoven web material.

37. A process in accordance with claim 36, wherein said bicomponent nonwoven web material comprises polypropylene and polyethylene.

38. A process in accordance with claim 33, wherein said internal surfactant is added to said polyolefin resin in an amount up to about 5% by weight of said polyolefin resin.

39. A process in accordance with claim 33, wherein said topical surfactant is applied to said nonwoven web material in an amount up to about 5% by weight of said nonwoven web material.

* * * * *